US006938775B2

(12) United States Patent
Gaffney et al.

(10) Patent No.: US 6,938,775 B2
(45) Date of Patent: Sep. 6, 2005

(54) BUTTON CELL BATTERY PACK WITH AIR ACCESS CHANNEL

(75) Inventors: Robert C. Gaffney, Sun Prairie, WI (US); Rodney S. McKenzie, Madison, WI (US); Marc L. Syvertsen, Madison, WI (US); Jeffrey W. Schmoeger, Deerfield, WI (US); Michael J. Johnstone, Madison, WI (US); Robert G. Reidl, Kendall, WI (US); Jeffrey A. Poirier, Madison, WI (US); Robert G. LaMasney, Cross Plains, WI (US); Ross J. Mack, Dane, WI (US)

(73) Assignee: Rovcal, Inc., Fresno, CA (US)

( * ) Notice: Subject to any disclaimer, the term of this patent is extended or adjusted under 35 U.S.C. 154(b) by 66 days.

(21) Appl. No.: 10/614,967

(22) Filed: Jul. 8, 2003

(65) Prior Publication Data

US 2004/0011698 A1 Jan. 22, 2004

Related U.S. Application Data

(63) Continuation-in-part of application No. 10/079,357, filed on Feb. 20, 2002, now Pat. No. 6,659,281.

(51) Int. Cl.[7] ..... B65D 85/00
(52) U.S. Cl. ..... 206/704; 206/471
(58) Field of Search ..... 206/703–705, 206/528, 530, 538, 539, 533, 461, 471, 806, 464, 465, 477, 486

(56) References Cited

U.S. PATENT DOCUMENTS

| | | | | |
|---|---|---|---|---|
| 2,899,046 | A | 8/1959 | Cox, Jr. | |
| 2,971,638 | A | 2/1961 | Allison et al. | |
| 3,433,351 | A | 3/1969 | Zabornev | |
| 3,995,767 | A | 12/1976 | Brindley et al. | |
| 4,209,091 | A * | 6/1980 | Lieberman | 206/704 |
| 4,270,659 | A | 6/1981 | Kuchenbecker | |
| 4,860,890 | A | 8/1989 | Cerny et al. | |
| 4,953,700 | A | 9/1990 | DeDino | |
| 5,033,616 | A | 7/1991 | Wyser | |
| 5,492,675 | A * | 2/1996 | Brizard | 206/461 |
| 5,795,667 | A | 8/1998 | McKenzie et al. | |
| 5,839,583 | A | 11/1998 | Pope et al. | |
| 6,039,185 | A | 3/2000 | Pedracine et al. | |
| D433,629 | S | 11/2000 | Clarke et al. | |
| 6,830,149 | B2 * | 12/2004 | Merboth et al. | 206/461 |

* cited by examiner

*Primary Examiner*—Luan K. Bui
(74) *Attorney, Agent, or Firm*—Quarles & Brady LLP

(57) ABSTRACT

A battery pack suitable for use with button cell batteries. The battery pack includes a flexible card and a cover rotatably fixed relative to said flexible card. A backing is interposed between the card and said cover, and fixed relative to said card. The backing and cover define an enclosed space interposed between the cover and the backing for receiving batteries. Batteries disposed in the space are enclosed by the cover and backing. An air access channel formed in the backing diffuses air to the batteries.

27 Claims, 7 Drawing Sheets

BUTTON CELL BATTERY PACK WITH AIR ACCESS CHANNEL

CROSS REFERENCES TO RELATED APPLICATIONS

This application is a continuation-in-part of U.S. patent application Ser. No. 10/079,357 filed on Feb. 20, 2002, now U.S. Pat. No. 6,659,281.

STATEMENT REGARDING FEDERALLY SPONSORED RESEARCH

Not Applicable

BACKGROUND OF THE INVENTION

The present invention relates to packaging for button cell batteries, and more particularly to button cell packs which inhibit pilfering.

Button cell batteries are typically used in hearing aids, and, are thus small in size having a diameter which cam be less than half the width of a finger. Moreover, the small battery size results in a limited power supply, and requires replacement in a hearing aid at regular intervals. In order to accommodate frequent replacement of these batteries, the batteries are typically sold in packages containing a plurality of the batteries.

One known battery package disclosed in U.S. Pat. No. 5,839,583 encloses six button cell batteries in a hard plastic case. The package is molded in one piece, and includes a base hingedly connected to a cover. The base includes pockets which receive the batteries. The pockets containing the batteries are covered by a sheet of plastic material which is adhesively attached to the base and each battery. The cover closes over the plastic covered batteries in the pockets. Absent wrapping the package to prevent access by a pilferer by simply opening the cover, there is no deterrent against pilfering. Additional wrapping is expensive, and increases the cost of an already expensive package.

A less expensive package known in the art includes a plastic cover rotatably mounted to a card. The cover includes receptacles which open to the card. Each receptacle receives a single battery which is accessed through a cutout formed in the card. The cover is rotated to align a battery with the cutout, and the battery is popped out of the receptacle through the cutout. The cutout is initially blocked by card material to prevent pilfering prior to purchase. Once a purchaser has removed the card material blocking the cutout, however, inadvertent rotation of the cover could cause a battery to unintentionally fall out of the package. In addition, the flexible card can be bent away from the cover to allow access to the batteries by a pilferer.

More secure packaging introduces an additional problem for batteries that require the diffusion of air while packaged, such as tabbed zinc air cells. Restricting air diffusion to the batteries can significantly reduce the effectiveness of the battery. This problem is disclosed in U.S. Pat. No. 5,795,667 which is assigned to the assignee of the present application. Accordingly, a need exists for a battery package which can accommodate air diffusion to the batteries packaged therein.

SUMMARY OF THE INVENTION

The present invention provides a battery pack for batteries. The battery pack includes a flexible card and a cover rotatably fixed relative to said flexible card. A backing is interposed between the card and said cover, and fixed relative to said card. The backing and cover define an enclosed space interposed between the cover and the backing for receiving batteries. Batteries disposed in the space are enclosed by the cover and backing. An air access channel formed in the backing diffuses air to the batteries.

A general objective is to provide a battery pack for button cells which can diffuse air to the batteries. This objective is accomplished by providing a backing having an air access channel.

This and still other objects and advantages of the present invention will be apparent from the description which follows. In the detailed description below, preferred embodiments of the invention will be described in reference to the accompanying drawings. These embodiments do not represent the full scope of the invention. Rather the invention may be employed in other embodiments. Reference should therefore be made to the claims herein for interpreting the breadth of the invention.

DETAILED DESCRIPTION OF THE INVENTION

Figure 1:
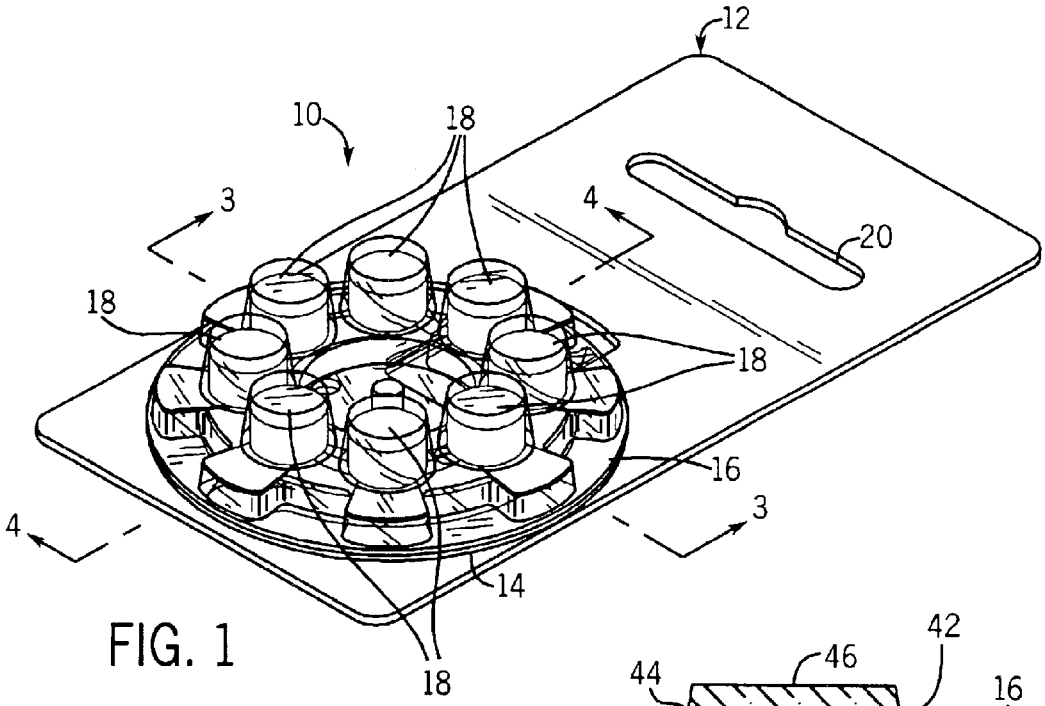
FIG. 1 is a perspective view of a battery pack incorporating the present invention.

Referring to FIGS. 1–8, a battery pack 10 includes a flexible card 12, a clear plastic backing 14 fixed to the card 12, and a clear plastic cover 16 rotatably fixed relative to the card 12 and backing 14. The cover 16 and backing 14 have overlapping structure which inhibits a pilferer from extracting one or more batteries 18, such as tabbed zinc air cells, interposed between the backing 14 and the card 12.

The flexible card 12 is, preferably, a die cut paperboard card which can carry identifying indicia and advertising thereon. A hanger slot 20 formed through the card 12 can be provided to facilitate hanging the battery pack 10 for display to potential purchasers. A circular opening 22 interposed between a pair of anchor holes 24 formed in the card 12 receives a cover center post 26 extending from the cover 16 through a central opening 28 in the backing 14. The anchor holes 24 receive anchors 30 extending from the backing 14 to prevent rotation of the backing 14 relative to the card 12. A rectangular flap cutout 32 formed in the card 12 between the circular opening 22 and hanger slot 20 provides access to a flap 34 formed part of the backing 14.

The disc shaped cover 16 is rotatably fixed relative to the card 12, and is preferably formed from a clear plastic which allows potential purchasers to view the batteries 18 in the pack 10. The cover 16 includes the center post 26 which is coaxial with a cover axis 36 of rotation. The center post 26 has a distal end 38 which extends through the central opening 28 of the backing 14 and through the circular opening 22 of the card 12. Preferably, the center post distal end 38 is thermally deformed, such that it is larger (shown in FIG. 5) than the card circular opening 22 to rotatably fix the cover 16 relative to the card 12. Although thermally deforming the center post distal end 38 is disclosed, other methods can be used to rotatably fix the cover 16 relative to the card 12, such as by using mechanical fasteners, a snap fit, and the like, without departing from the scope of the present invention.

Figure 5:
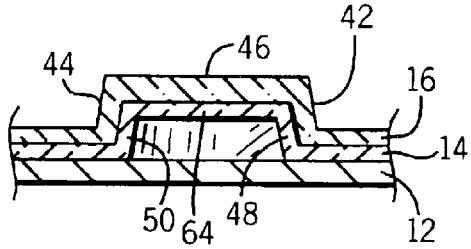
FIG. 5 is a detailed cross sectional view of the pack of FIG. 1 between a pair of adjacent receptacles.
Figure 3:
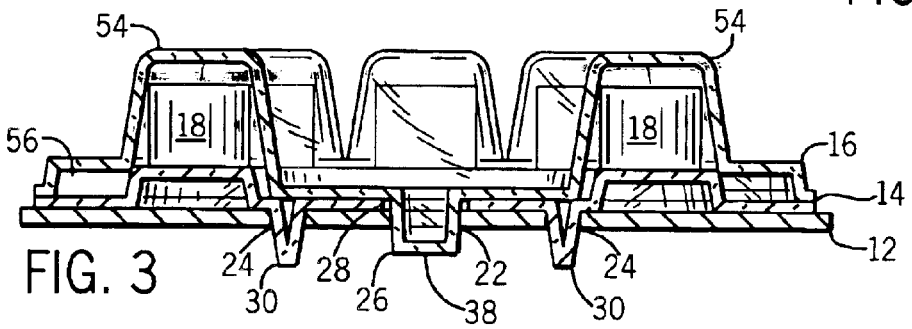
FIG. 3 is a cross sectional view along line 3—3 of FIG. 1.

An annular cavity 40 formed in the cover 16 is coaxial with the axis 36, and opens toward the card 12. The annular cavity 40 includes opposing sidewalls 42, 44 joined by a top wall 44. As best shown in FIG. 5, the axially extending annular cavity sidewalls 42, 44 overlap sidewalls 48, 50 of a platform 52 extending from the backing 14 to inhibit pilfering.

A plurality of battery receptacles 54 are formed in the annular cavity top wall 46, and open toward the card 12. The receptacles 54 are spaced equidistantly from the axis 36, and are individually sized to receives one of the disc shaped batteries 18. Although each receptacle 54 is shown to receive a single disc shaped battery 18, the receptacles can be formed to receive more than one battery and batteries which are not disc shaped, without departing from the scope of the invention.

A plurality of indents 56 is formed in the cover 16, and each indent is equidistantly space about a diameter of the cover 16. Each indent 56 opens toward the backing 14, and is engageable with a protrusion 58 extending from the backing 14. Preferably, each indent 56 is radially aligned with one of the battery receptacles 54 to index the receptacles 54 aligned with the flap 34 as the cover 16 rotates about the axis 36. Although a plurality of indents 56 formed in the cover 16 which are engageable with the protrusion 58 extending from the backing 14 is disclosed, other methods for indexing the rotation of the cover can be used without departing from the scope of the invention, such as providing a plurality of protrusions which engage one or more indents, forming the indents in the backing and the protrusions on the cover, and the like.

The disc shaped backing 14 is sandwiched between the card 12 and the cover 16, and is preferably formed from a clear plastic which allows a potential purchaser to view at least one battery 18 through the flap cutout 32. Advantageously, the plastic backing 14 provides a low friction surface on which the cover 16 rotates. Moreover, the backing 14 prevents a pilferer from gaining access to the batteries 18 interposed between the backing 14 and cover 16 by merely bending the card 12.

The pair of anchors 30 extending from the backing 14 through the anchor holes 24 formed in the card 12 prevent rotation of the backing 14 relative to the card 14. Of course, the backing 14 can be fixed to the card 12 using other methods, such as adhesives, mechanical fasteners, and the like without departing from the scope of the invention.

The semi-annular platform 52 formed in the backing 14 extends away from the card 12, and has a pair of opposing ends 60, 62 and the sidewalls 48, 50 joined by a top wall 64. The platform 52 extends into the annular cavity 40 formed in the cover 16, and the platform sidewalls 48, 50 overlap the annular cavity sidewalls 44, 46 to provide the overlapping structure which inhibits pilfering. Advantageously, the platform 52 traps each battery 18 in one of the receptacles 54 formed in the cover 16 to space the batteries 18 from the card 12, and further inhibit pilfering of the batteries 18.

The overlapping structure inhibits pilfering which occurs by a pilferer bending the flexible card 12 away from the cover 16 to gain access to the batteries 18. Although axially extending cover sidewalls 44, 46 overlapping the platform sidewalls 48, 50 to inhibit pilfering is disclosed, other overlapping structure, such as an axially extending lip formed at the circumference of the cover which extends past the circumferential edge of the backing, can be provided to inhibit pilfering without departing from the scope of the invention.

The height of the platform 52 is directly related to the effectiveness of the overlapping structure to inhibit pilfering. In particular, the higher the platform height, i.e. the further the platform 52 extends into the cover annular cavity 40, the more effective the overlapping structure is for inhibiting pilfering. The height is dependent upon several factors, such as battery size, package size, formability of the material, and the like. Preferably, the platform top wall 64 slidably engages the annular cavity top wall 46 to take advantage of the full depth of the cover annular cavity 40.

Figure 9:
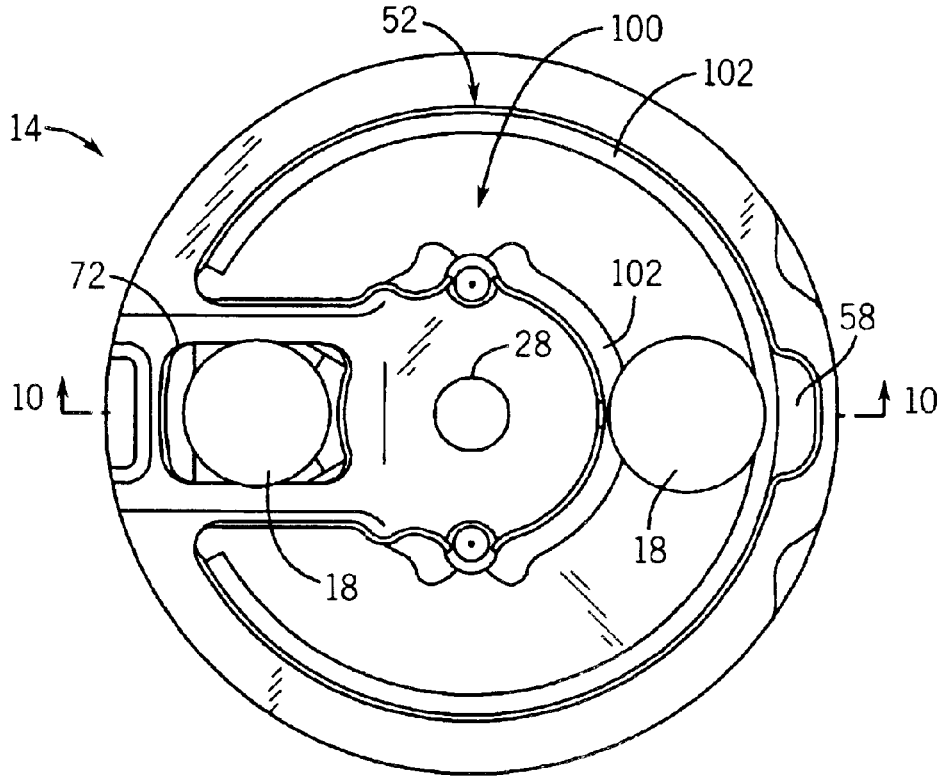
FIG. 9 is a top view of the backing of FIG. 1 including an air access channel.
Figure 10:
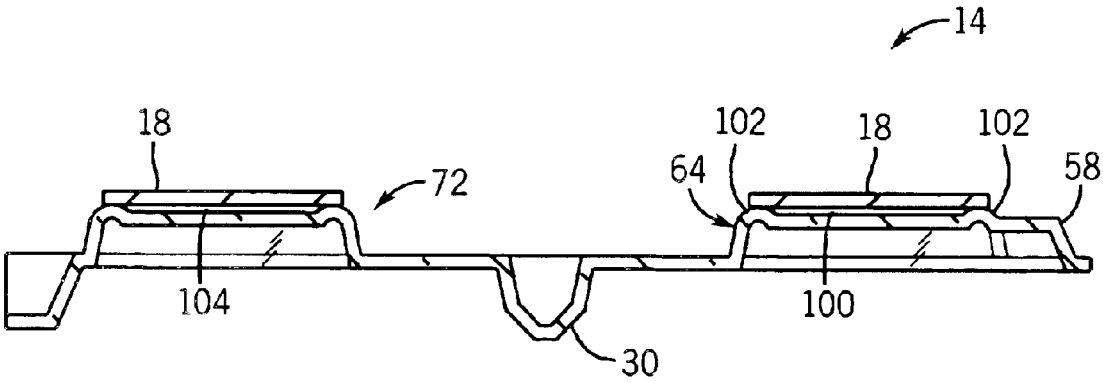
FIG. 10 is a cross sectional view along line 10—10 of FIG. 9.

Referring now to FIGS. 9 and 10, a groove 100 formed in the platform top wall 64 defines a pair of radially spaced ridges 102 that engage the batteries 18 to form an air access channel beneath the batteries 18. The width of the groove 100 is dependent on the particular. battery size. Preferably, the width of the groove 100 is not less than a circle defined by the position of air holes in the battery side engaging the platform 52, and the width of the groove 100 is not greater than the battery diameter. The depth of the groove 100 is, preferably sufficient to allow air to enter the groove 100, but shallow enough so as not to weaken the platform 52 or interfere with the rotation of the cover 16.

Figure 11A:
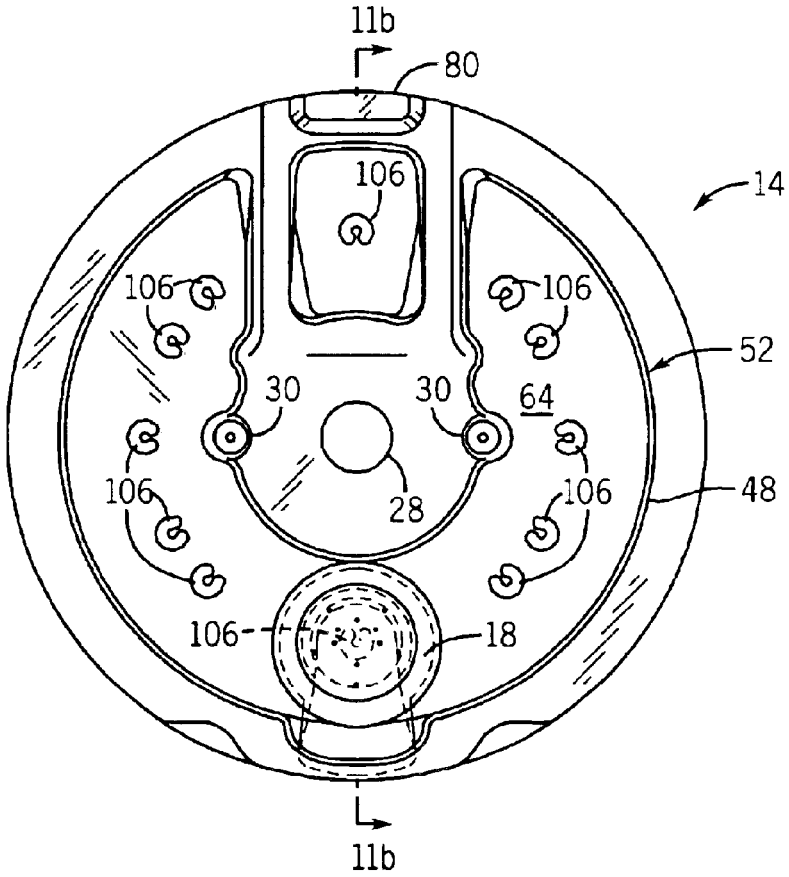
FIG. 11*a* is a top view of an alternative embodiment of the backing including dimples to form the air access channel.
Figure 11B:
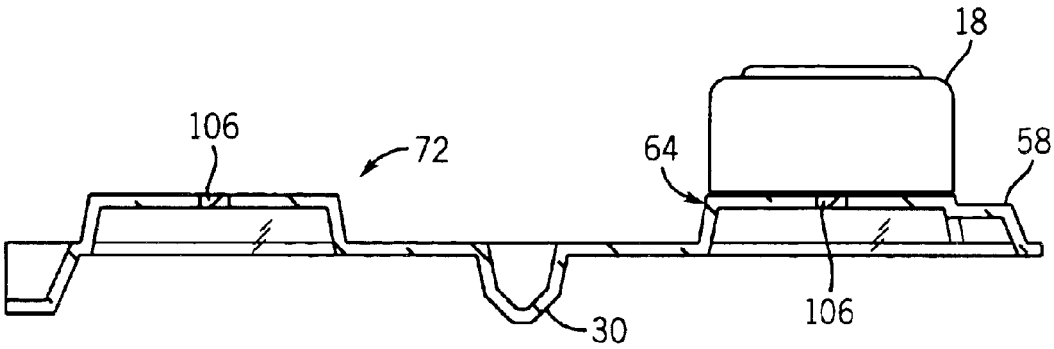
FIG. 11*b* is a side cross sectional view along line 11*b*–11*b* of FIG. 11*a*.
Figure 12:
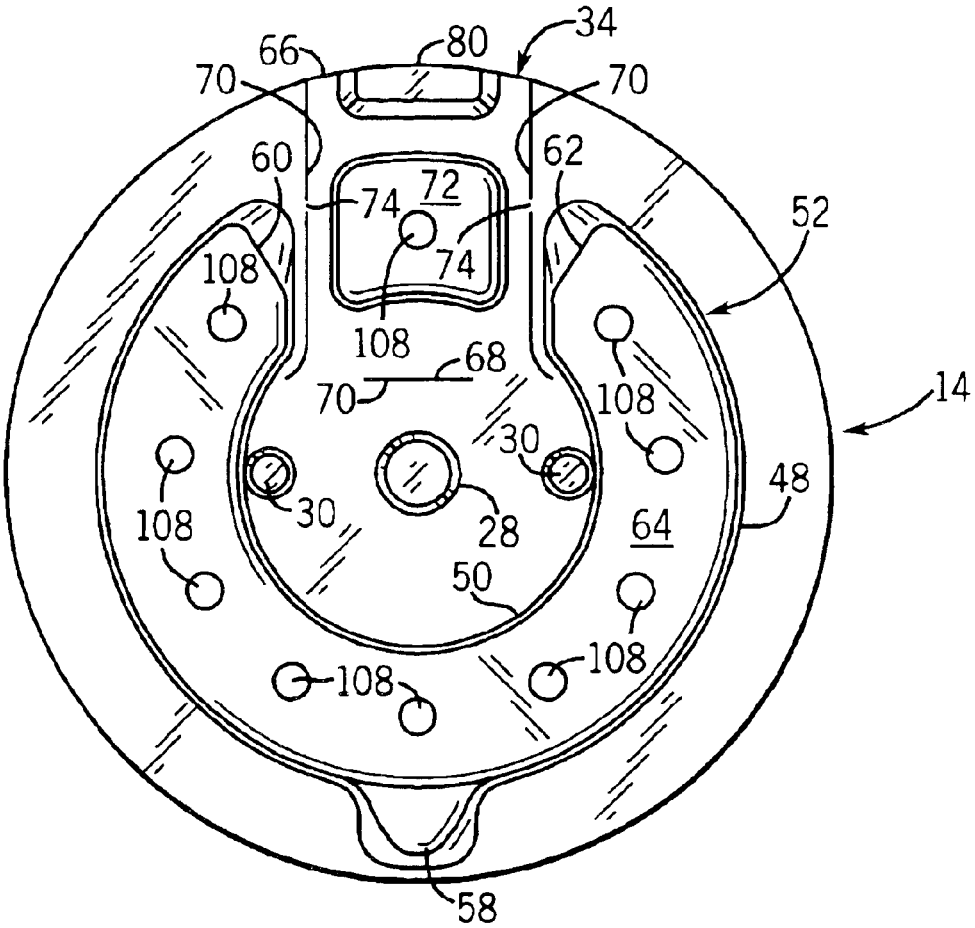
FIG. 12 is a top view of another alternative embodiment of the backing includes holes to form the air access channel.

Although a groove 100 forming the air access channel is preferred, other methods for providing an air access channel can be used without departing from the scope of the invention. For example, raised structure extending above the platform top wall 64, such as dimples 106 shown in FIGS. 11*a* and 11*b* can be provided which raise the batteries above the platform top wall to provide a channel beneath the batteries, a single ridge formed along a radial edge of the platform top wall can be provided to raise an edge of each battery above the platform an form the channel beneath the batteries, and holes 108, such as shown in FIG. 12, formed in the platform top wall beneath the batteries can formed the air access channel. Of course, other variations of the preferred embodiment and above examples can be provided by one skilled in the art without departing from the scope of the invention.

The air access channel allows the diffusion of air to the batteries 18 while the batteries are held securely between the platform 52 and cover 16. Advantageously, the air access channel provides unrestricted air to the side of the batteries 18 engaging the ridges 102, and there is no compression of a pressure sensitive adhesive 82 (shown in FIG. 2) over the batteries' air access holes which could then be obstructed. Moreover, by forming the air access channel in the platform 52, as the batteries 18 are rotated for dispensing, the orientation of the air channel relative to the batteries 18 is maintained.

Figure 4:
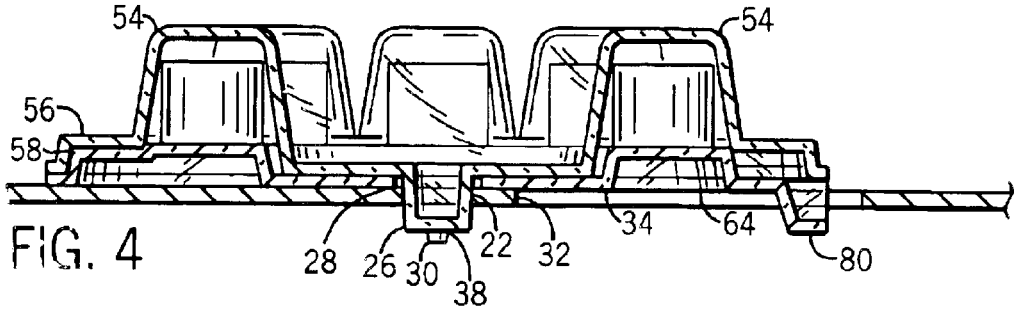
FIG. 4 is a cross sectional view along line 4—4 of FIG. 1.
Figure 2:
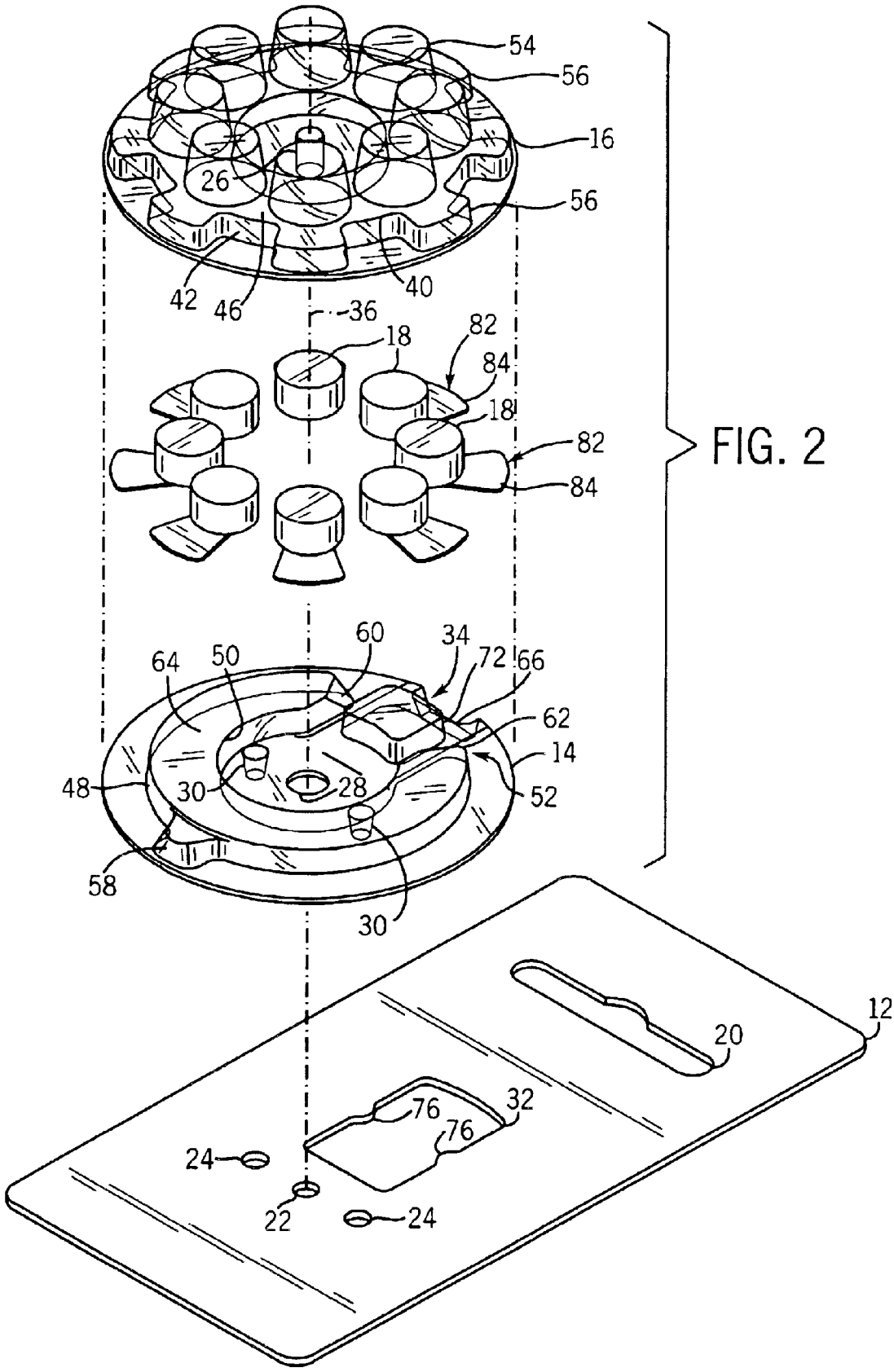
FIG. 2 is an exploded perspective view of the pack of FIG. 1.

As shown in FIGS. 2 and 4, the protrusion 58 radially adjacent the platform 52 extends toward the cover 16, and is engageable with the indents 56 formed in the cover 16. The protrusion 58 and indents 56 allow the cover 16 to be indexed as the cover 16 rotates about the axis 36. The indexing positions the cover 16, such that upon engagement of the protrusion 58 with an indent 54, a battery 18 disposed in one of the receptacles 18 is aligned with the flap cutout 32 for access by a purchaser. Advantageously, the indexing also prevents inadvertent rotation of the cover 16 which may align a battery 18 with the cutout 32 when the flap 34 is not in the closed position resulting in a battery 18 falling out of the pack 10.

The flap 34, shown in FIGS. 2, 4, 6, and 7, is formed as an integral part of the backing 14, and has a top 66 and bottom 68 joined by side edges 70. The bottom 68 is hingedly connected to the backing 14 by a living hinge 70. Pivoting the flap 34 away from the cover 16 through the flap cutout 32 to an open position provides access to the battery 18 in the cover receptacle 54 aligned with the flap 34 and cutout 32.

A flap platform 72 formed in the flap 34, and extending away from the card 12, is interposed between the semi-annular platform ends 60, 62 formed in the backing 14 to fill the gap between the semi-annular form ends 60, 62. The flap platform 72 prevents batteries 18 from lodging in the gap between the ends 60, 62 when the cover 16 rotates about the cover axis 36 of rotation. Preferably, a groove 104 is formed in the flap platform 72, such as shown in FIGS. 9 and 10, to provide an air access channel for the battery 18 supported by the flap platform 72.

Figure 7:
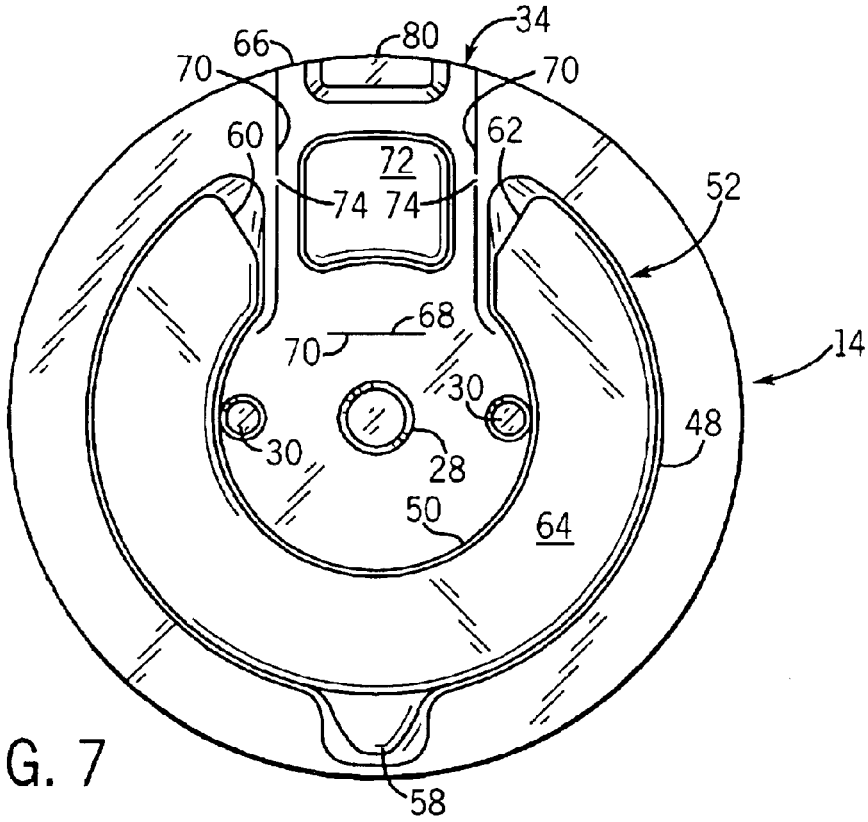
FIG. 7 is a top view of the backing of FIG. 1.
Figure 8:
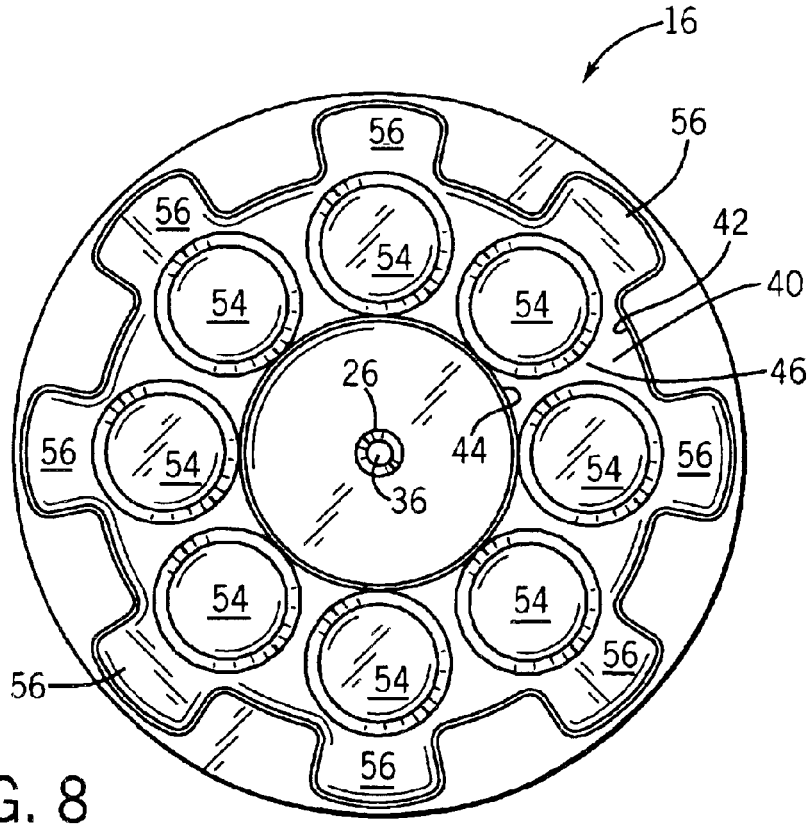
FIG. 8 is a bottom view of the cover of FIG. 1.

As shown in FIG. 7, the flap edges 70 are initially fixed to the backing 14 by tack points 74 which join the edges 70 to the backing 14 to hold the flap 34 in a closed position. In order to access the batteries 18, however, the tack points 74 are severed to allow the flap 34 to pivot through the cutout 32 to the open position. Although tack points are disclosed to initially hold the flap in the closed position, other methods can be used, such as an adhesive strip covering the cutout, can be used without departing from the scope of the invention.

Figure 6:
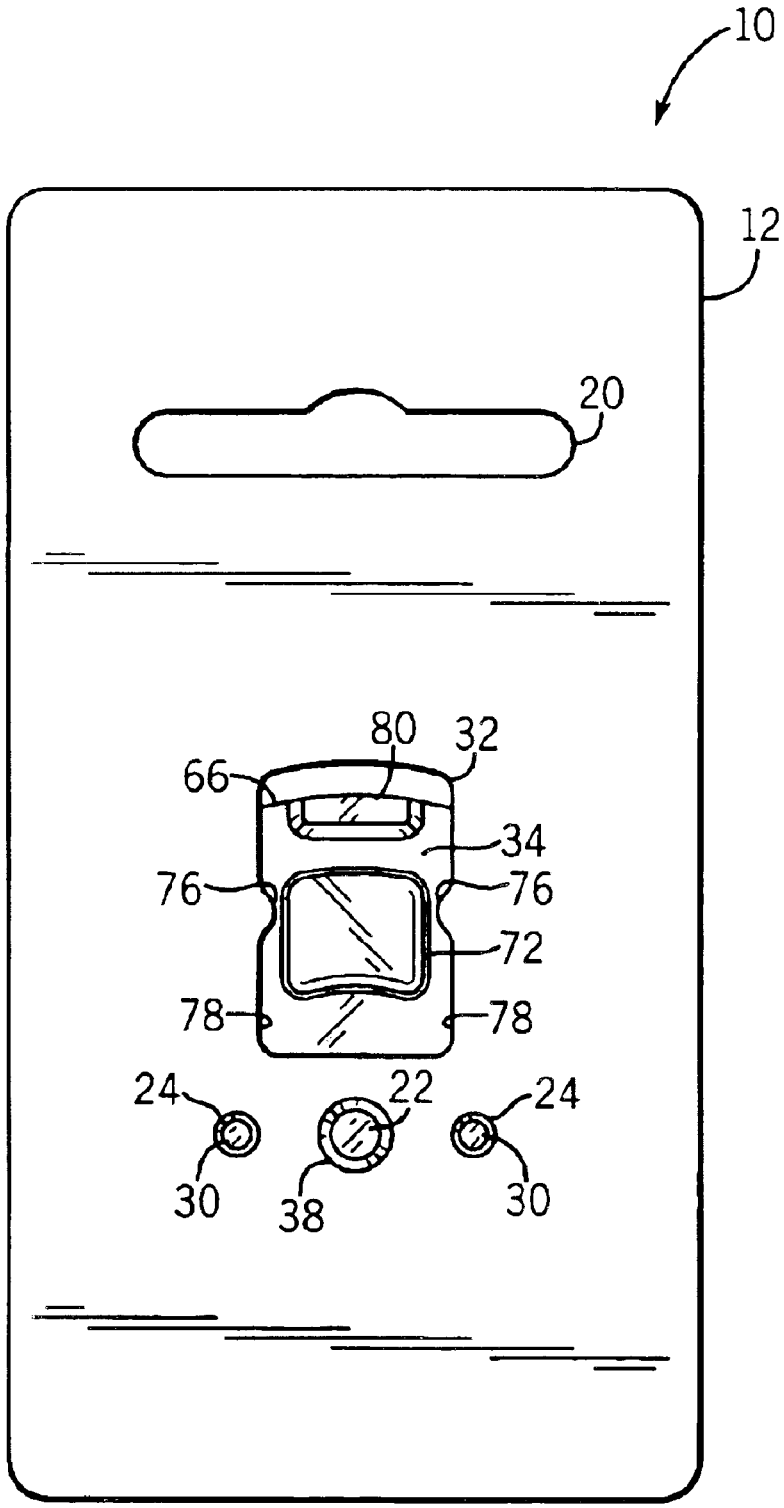
FIG. 6 is a rear view of the pack of FIG. 1.

Referring to FIGS. 6 and 7, once the tack points 74 are severed, the flap 34 is held in the closed position by tabs 76 extending inwardly into the card cutout 32 from the cutout edges 78. When moving the flap 34 to the open position, the tabs 76 and/or the flap 34 deform to allow the flap 34 to pass through the cutout 32 past the tabs 76 away from the cover 16. Similarly, when moving the flap 34 to the closed position, the tabs 76 and/or the flap 34 deform to allow the flap 34 to pass through the cutout 32 past the tabs 76 toward the cover 16.

As shown in FIGS. 4, 6, and 7, the flap top 66 includes a lip 80 which extends through the cutout 32. The lip 80 is engageable by the user to pivot the flap 34 through the cutout 32 and gain access to a battery 18 aligned with the flap 34. Although the lip 80 is preferred, any structure which allows a user to engage the flap 34 through the cutout 32, such as a handle extending radially and axially past the cover which allows pushing the flap through the cutout, and the like, without departing from the scope of the invention. Moreover, the lip can be eliminated without departing from the scope of the invention.

Referring now to FIG. 2, the batteries 18 are interposed between the cover 16 and backing 14, and are urged into the receptacles 54 by the backing platform 64. The batteries 18 can be any battery known in the art, such as a zinc air battery suitable for use as a hearing aid battery. A self-adhesive tab 82 is fixed to each battery 18 to prevent premature discharge of the zinc air battery by covering openings in the battery 18 which allows atmospheric oxygen to enter the battery 18. Advantageously, the tab 82, as is known in the art, simplifies handling and positioning the battery when inserting the battery 18 in a battery operated device. Preferably, the free end 84 of each tab 82 is received in the indent 56 formed adjacent the receptacle 54 receiving the battery 18 fixed to the tab 82.

In use, with reference to FIGS. 1–8, the cover 16 is rotated about the axis 36 of rotation until the protrusion 58 engages an indent 56 to align a receptacle 54 containing a battery 18 with the card cutout 32. A purchaser engages the flap lip 80 using a finger, and pulls axially outwardly and radially inwardly to severe the tack points 74 joining the flap edges 70 to the backing 14 to pivot the flap 34 past the tabs 76 through the cutout 32 to expose the battery 18. The purchaser then pops the battery 18 out of the receptacle 54 by positioning the pack 10, such the receptacle 54 opens downwardly through the cutout 32, and gravity urges the battery 18 out of the receptacle 54 into the purchaser's hand.

The pack 10 is closed by pivoting the flap 34 back through the cutout 32 past the tabs 76 toward the cover 16. The tabs 76 hold the flap 34 in the closed position until another battery 18 is desired, and the purchaser forces the flap 34 past the tabs 76 to the open position.

While there has been shown and described what are at present considered the preferred embodiments of the invention, it will be obvious to those skilled in the art that various changes and modifications can be made therein without departing from the scope of the invention defined by the appended claims.

We claim:

1. A battery pack suitable for use with button cell batteries, said battery pack comprising:

a flexible card;

a backing fixed to said card;

a platform extending from said backing away from said card for supporting the batteries;

an air access channel formed in said platform for allowing air to diffuse to the batteries supported by said platform;

a cover rotatably fixed to at least one of said backing and said card; and a cavity formed in said cover and opening to said card, and said cavity receiving said platform to inhibit access to a battery interposed between said cover and said backing.

2. The battery pack as in claim 1, in which said cavity formed in said cover is annular, and said platform formed in said backing is at least semi-annular, wherein said semi-annular platform is received in said annular cavity, and sides of said cavity overlap sides of said platform.

3. The battery pack as in claim 1, in which a plurality of receptacles are formed in a wall of said cavity and open toward said backing, wherein each of said receptacles are sized for receiving a single battery.

4. The battery pack as in claim 1, in which said air access channel is formed by a groove formed in a top wall of said platform.

5. The battery pack as in claim 1, in which said air access channel is formed by dimples formed in a top wall of said platform.

6. The battery pack as in claim 1, in which said air access channel is formed by holes formed through a top wall of said platform.

7. The battery pack as in claim 1, in which a flap hingedly connected to said backing extends radially from a center of said backing to provide access to a battery interposed between said flap and said cover.

8. The battery pack as in claim 7, in which said flap includes a flap platform for supporting a battery, and said flap platform includes an air access channel.

9. The battery pack as in claim 7, in which said flap pivots through an opening formed in said card to provide access to the battery interposed between said flap and aid cover.

10. The battery pack as in claim 1, in which a plurality of batteries engaging said platform are interposed between said backing and said cover.

11. A battery pack suitable for use with button cell batteries, said battery pack comprising:

a flexible card;

a backing fixed to said card;

a platform extending from said backing away from said card for supporting the batteries, said platform having a top wall;

at least one structure extending from said platform top wall for engaging a battery to form an air access channel beneath the battery for allowing air to diffuse to the battery;

a cover rotatably fixed to at least one of said backing and said card over said platform to sandwich a battery between said platform and cover.

12. The battery back as in claim 11 including a cavity formed in said cover and opening to said card, and said cavity receiving said platform to inhibit access to a battery interposed between said cover and said backing.

13. The battery pack as in claim 12, in which said cavity formed in said cover is annular, and said platform formed in said backing is at least semi-annular, wherein said semi-annular platform is received in said annular cavity, and sides of said cavity overlap sides of said platform.

14. The battery pack as in claim 12, in which a plurality of receptacles are formed in a wall of said cavity and open toward said backing, wherein each of said receptacles are sized for receiving a single battery.

15. The battery pack as in claim 11, in which said structure is at least one ridge extending from said platform top wall away from said card.

16. The battery pack as in claim 11, in which said structure includes dimples formed in said platform top wall.

17. The battery pack as in claim 11, in which said structure includes holes formed through said platform top wall.

18. The battery pack as in claim 11 in which a flap hingedly connected to said backing extends radially from a center of said backing to provide access to a battery interposed between said flap and said cover.

19. The battery pack as in claim 18, in which said flap includes a flap platform for supporting a battery, and said flap platform includes structure forming air access channel.

20. The battery pack as in claim 18, in which said flap pivots through an opening formed in said card to provide access to the battery interposed between said flap and aid cover.

21. The battery pack as in claim 11, in which a plurality of batteries engaging said platform are interposed between said backing and said cover.

22. A battery pack suitable for use with button cell batteries, said battery pack comprising:

a card;

a backing having a top and a bottom, said backing fixed to said card;

a platform extending from said backing top for supporting the batteries;

an air access channel formed in said platform for allowing air to diffuse to the batteries supported by said platforms;

a cover rotatably fixed to at least one of said backing and said card, the cover defining a cavity formed therein, the cavity opening to said card, and said cavity receiving said platform to inhibit access to a battery interposed between said cover and said backing.

23. The battery pack as in claim 22, in which a plurality of receptacles are formed in a wall of said cavity and open toward said backing, wherein each of said receptacles are sized for receiving a single battery.

24. The battery pack as in claim 22, in which said air access channel is formed by a groove formed in a top wall of said platform.

25. The battery pack as in claim 22, in which said air access channel is formed by dimples formed in a top wall of said platform.

26. The battery pack as in claim 22, in which said air access channel is formed by holes formed through a top wall of said platform.

27. The battery pack as in claim 22, in which a plurality of batteries engaging said platform are interposed between said backing and said cover.

* * * * *